US011498807B2

(12) United States Patent
Haag et al.

(10) Patent No.: US 11,498,807 B2
(45) Date of Patent: Nov. 15, 2022

(54) FASTENING ARRANGEMENT FOR ELEVATOR GUIDE RAILS

(71) Applicant: KONE Corporation, Helsinki (FI)

(72) Inventors: Mikael Haag, Helsinki (FI); Harri Mäkinen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 138 days.

(21) Appl. No.: 17/165,271

(22) Filed: Feb. 2, 2021

(65) Prior Publication Data

US 2021/0238011 A1 Aug. 5, 2021

(30) Foreign Application Priority Data

Feb. 3, 2020 (EP) ..... 20155089

(51) Int. Cl.
*B66B 7/02* (2006.01)

(52) U.S. Cl.
CPC ..... *B66B 7/024* (2013.01); *B66B 7/023* (2013.01)

(58) Field of Classification Search
CPC ..... B66B 7/023; B66B 7/024; A44B 11/10
See application file for complete search history.

(56) References Cited

U.S. PATENT DOCUMENTS 11,174,980 B1 * 11/2021 Tran ..... A61H 5/00
2018/0370766 A1 * 12/2018 Madureira De Almeida ..... B66B 7/024
2022/0024722 A1 * 1/2022 Hosemann ..... B66B 19/002

FOREIGN PATENT DOCUMENTS

EP 2 993 152 A1 3/2016
ES 2557505 A1 * 1/2016 ..... B66B 7/024
JP 3-177287 A 8/1991
JP 2013-193857 A 9/2013
WO WO 2011/077012 A1 6/2011

OTHER PUBLICATIONS

European Search Report issued in EP 20155089.4, dated Aug. 28, 2020.

* cited by examiner

*Primary Examiner* — Minh Truong
(74) *Attorney, Agent, or Firm* — Birch, Stewart, Kolasch & Birch, LLP

(57) ABSTRACT

An arrangement includes two bracket parts, each bracket part includes a vertical branch and a horizontal branch attached by two fastening points. Each fastening point includes a longitudinal opening in each horizontal branch and a first fastening member passing vertically through the two longitudinal openings into a nest supported on a horizontal branch. A second fastening member extends horizontally into the nest and is operatively connected within the nest to the first fastening member via a power transmission. Rotation of the second fastening member generates a pressure joint between the two horizontal branches in the fastening point.

20 Claims, 6 Drawing Sheets

FASTENING ARRANGEMENT FOR ELEVATOR GUIDE RAILS

FIELD

Figure 1:
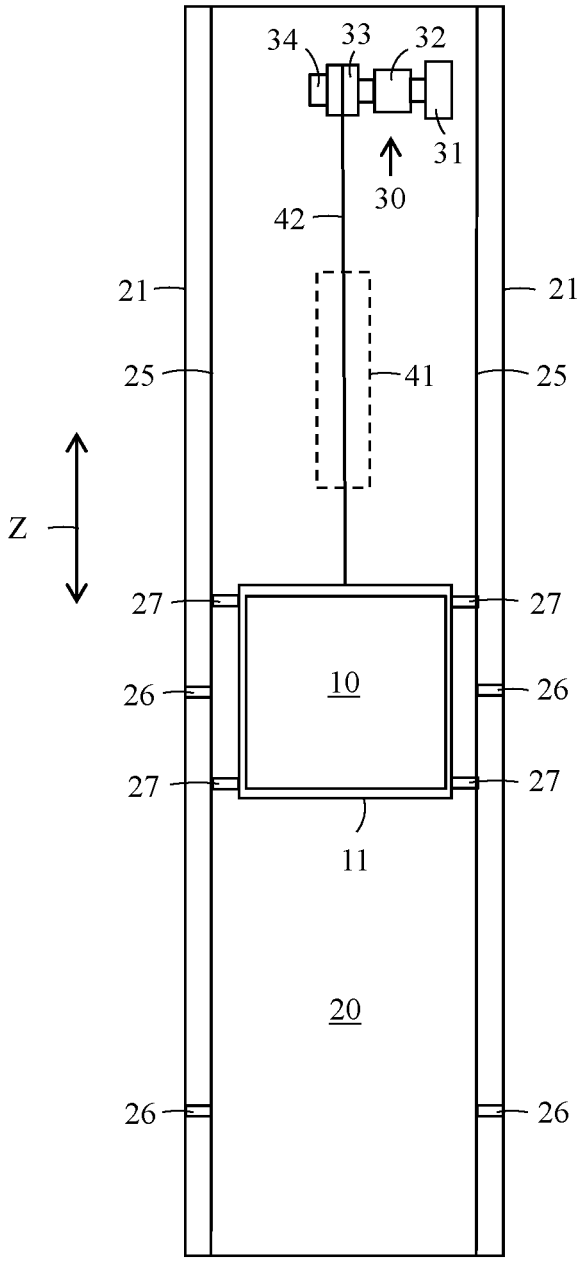

The invention relates to a fastening arrangement for elevator guide rails.

BACKGROUND

An elevator may comprise a car, a shaft, hoisting machinery, ropes, and a counterweight. A separate or an integrated car frame may surround the car.

The hoisting machinery may be positioned in the shaft. The hoisting machinery may comprise a drive, an electric motor, a traction sheave, and a machinery brake. The hoisting machinery may move the car upwards and downwards in the shaft. The machinery brake may stop the rotation of the traction sheave and thereby the movement of the elevator car.

The car frame may be connected by the ropes via the traction sheave to the counterweight. The car frame may further be supported with guide means at guide rails extending in the vertical direction in the shaft. The guide rails may be attached with fastening brackets to the side wall structures in the shaft. The guide means keep the car in position in the horizontal plane, when the car moves upwards and downwards in the shaft. The counterweight may be supported in a corresponding way on guide rails that are attached to the wall structure of the shaft.

The car may transport people and/or goods between the landings in the building. The wall structure of the shaft may be formed of solid walls or of an open beam structure or of any combination of these.

The guide rails may be formed of guide rail elements of a certain length. The guide rail elements may be connected in the installation phase end-on-end one after the other in the elevator shaft. The ends of the guide rail elements may be attached to each other with connection plates or form locking means. The guide rails may be attached to the walls of the elevator shaft with fastening brackets.

Prior art fastening brackets may comprise three bracket parts. Two of the bracket parts have an L-shape with a vertical branch and a horizontal branch and the third bracket part is straight. The horizontal branches of the L-shaped bracket parts may be attached to each other in two first fastening points. Each first fastening point may comprise an opening in each of the horizontal branches and a first fastening member passing through the openings. One of the openings may be longitudinal in a first horizontal direction in order to allow adjustment of the horizontal branches of the L-shaped bracket parts in relation to each other in the first longitudinal direction. The third bracket part may be attached to the vertical branch of the second bracket part in two second fastening points. Each second fastening point may comprise an opening in the vertical branch of the second bracket part and in the third bracket part and a second fastening member passing through the openings. One of the openings may be longitudinal in a second horizontal direction in order to allow adjustment of the second bracket part and the third bracket part in relation to each other in the second longitudinal direction. The bracket parts may thus be adjusted in two perpendicular horizontal directions in order to align the guide rails. The vertical branch of the first bracket part may be attached to a wall in the shaft. The guide rail may be attached to the third bracket part.

The first fastening points in such prior art fastening brackets are directed in the vertical direction and positioned behind the vertical branch of the second bracket part. The access to the first fastening points is thus problematic.

EP 2 993 152 discloses an apparatus and method for aligning guide rails in an elevator shaft. The apparatus disclosed in this prior art document may be used in aligning guide rails in the present application.

SUMMARY

An object of the invention is an improved fastening arrangement for elevator guide rails.

The fastening arrangement for elevator guide rails according to the invention is defined in claim 1.

The fastening arrangement comprises two bracket parts with a width direction and a perpendicular depth direction, each bracket part comprising a vertical branch and a horizontal branch, two fastening points for mutual attachment of the horizontal branches of the two bracket parts, each fastening point comprising a first longitudinal opening extending in the width direction in a first horizontal branch, a second longitudinal opening extending in the depth direction in a second horizontal branch, and a first fastening member passing vertically through the two longitudinal openings.

The fastening arrangement comprises further a structure forming a nest supported on the first horizontal branch so that the first fastening member extends vertically into the nest and a second fastening member extends horizontally into the nest, the first fastening member and the second fastening member being operatively connected to each other via a power transmission within the nest, whereby rotation of the second fastening member around a longitudinal centre axis of the second fastening member is transferred in the power transmission to a vertical linear movement of the first fastening element generating a pressure joint between the two horizontal branches of the two bracket parts in the fastening point.

The fastening arrangement according to the invention may be used in connection with manual and automatic alignment of guide rails. Alignment of the guide rails may in the inventive fastening arrangement be done by simply loosening only the second fastening member in each fastening point. Loosening of the second fastening member in each fastening point will make it possible to adjust the two bracket parts in relation to each other so that the guide rails are aligned in two perpendicular horizontal directions and further rotated slightly in relation to each other in order to adjust the twist of the guide rail.

The head of the second fastening member is seating on the vertical front wall of the nest in the fastening points on both sides of the guide rail. There is thus free access in the horizontal direction to the head of the second fastening member e.g. from an installation platform moving upwards and downwards in the shaft.

The novel fastening arrangement will speed up a manual alignment of the guide rails considerably. A manual alignment may be done so that the second fastening members are loosened and tightened manually and also the guide rails are aligned manually. Another possibility would be to loosen and tighten the second fastening members manually, but to align the guide rails automatically with an automatic alignment tool.

The novel fastening arrangement will make it possible to fully automate the alignment of the guide rails. An industry robot may be used on the installation platform for loosening and tightening the second fastening elements in the fastening points. An automatic alignment tool may further be used to align the guide rails when the second fastening members have been loosened.

DRAWINGS

Figure 2:
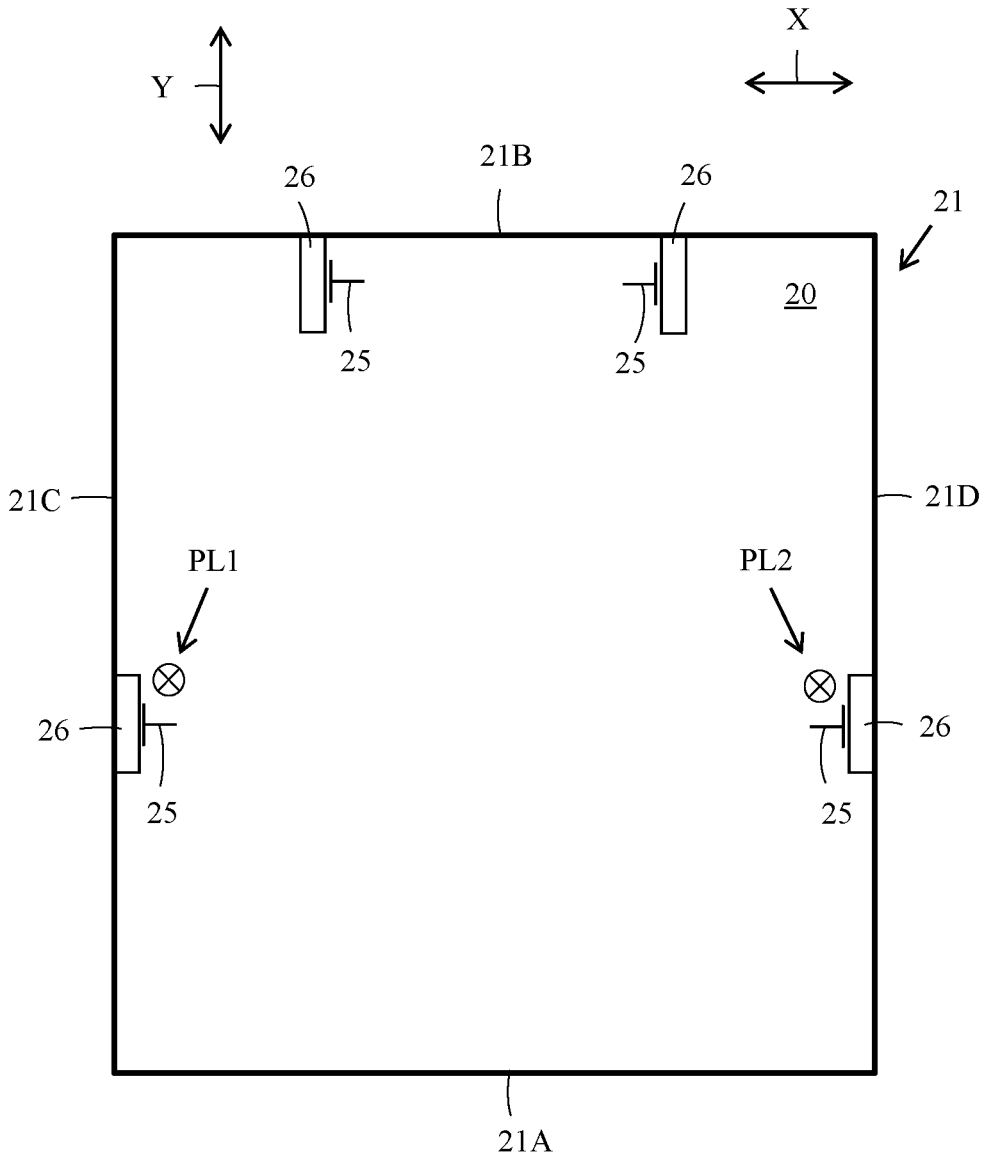
Figure 3:
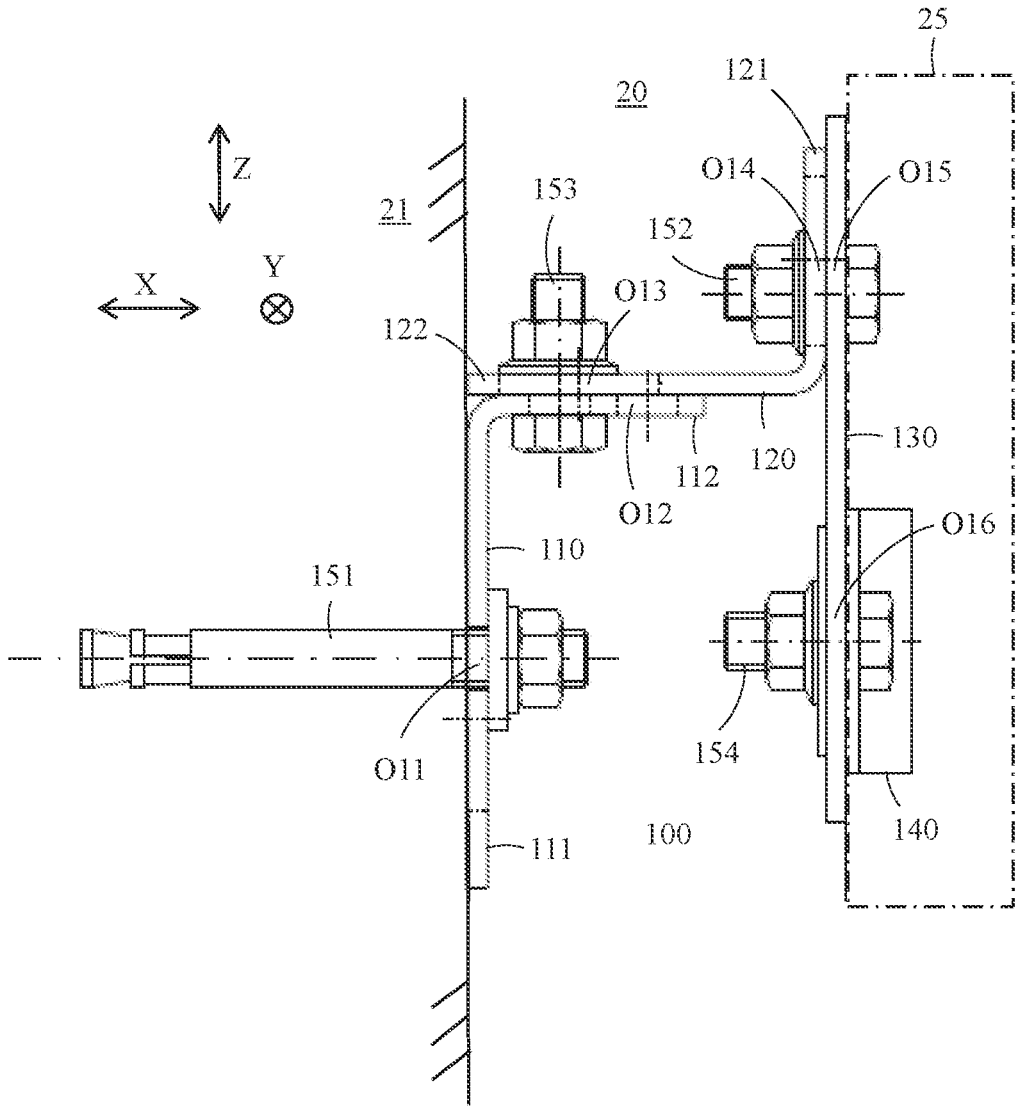
Prior Art FIG. 3
Figure 4A:
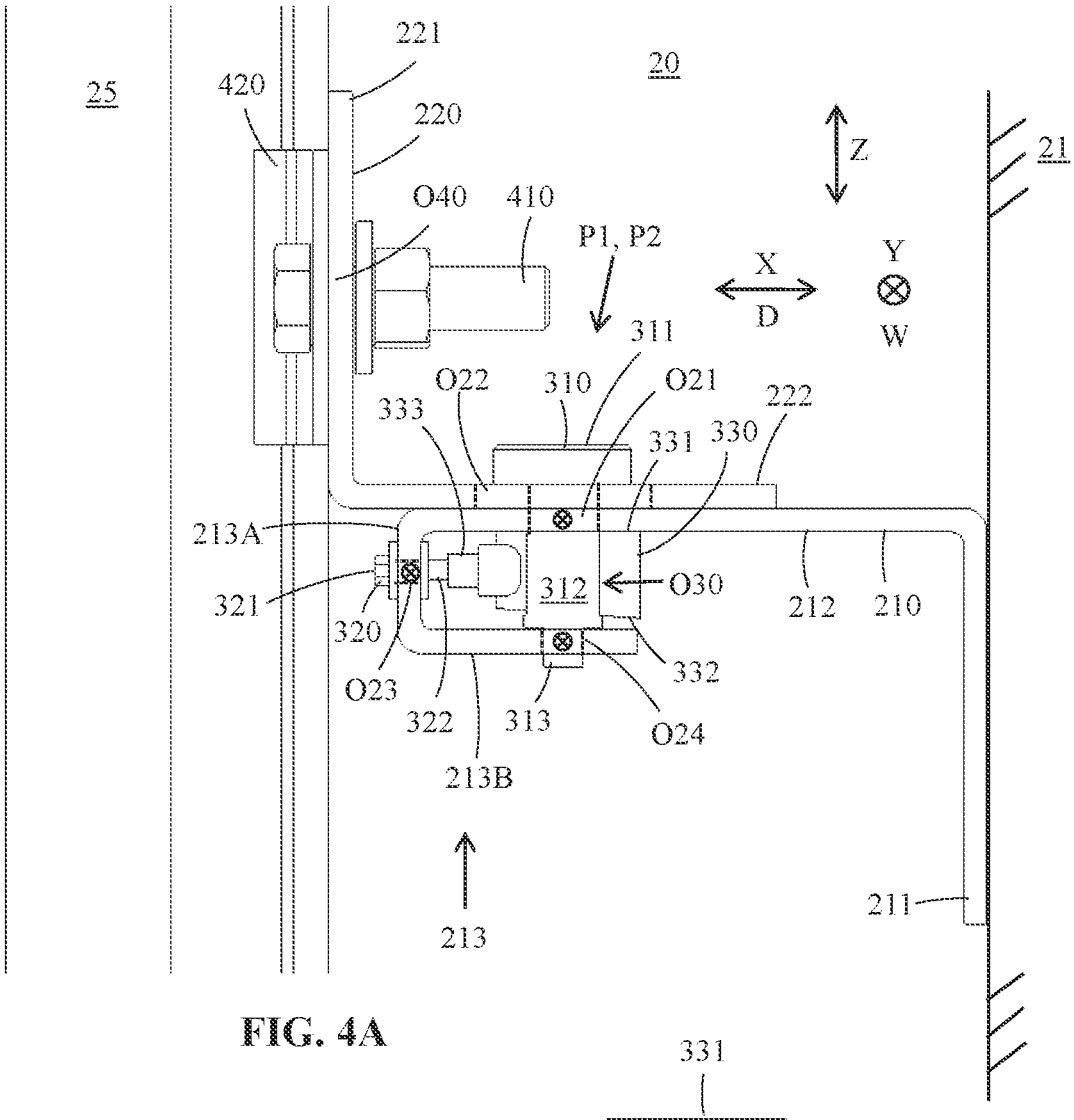
Figure 4B:
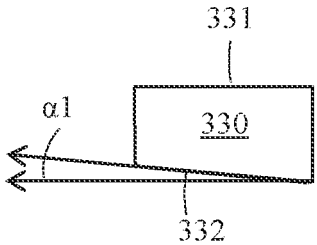
Figure 5:
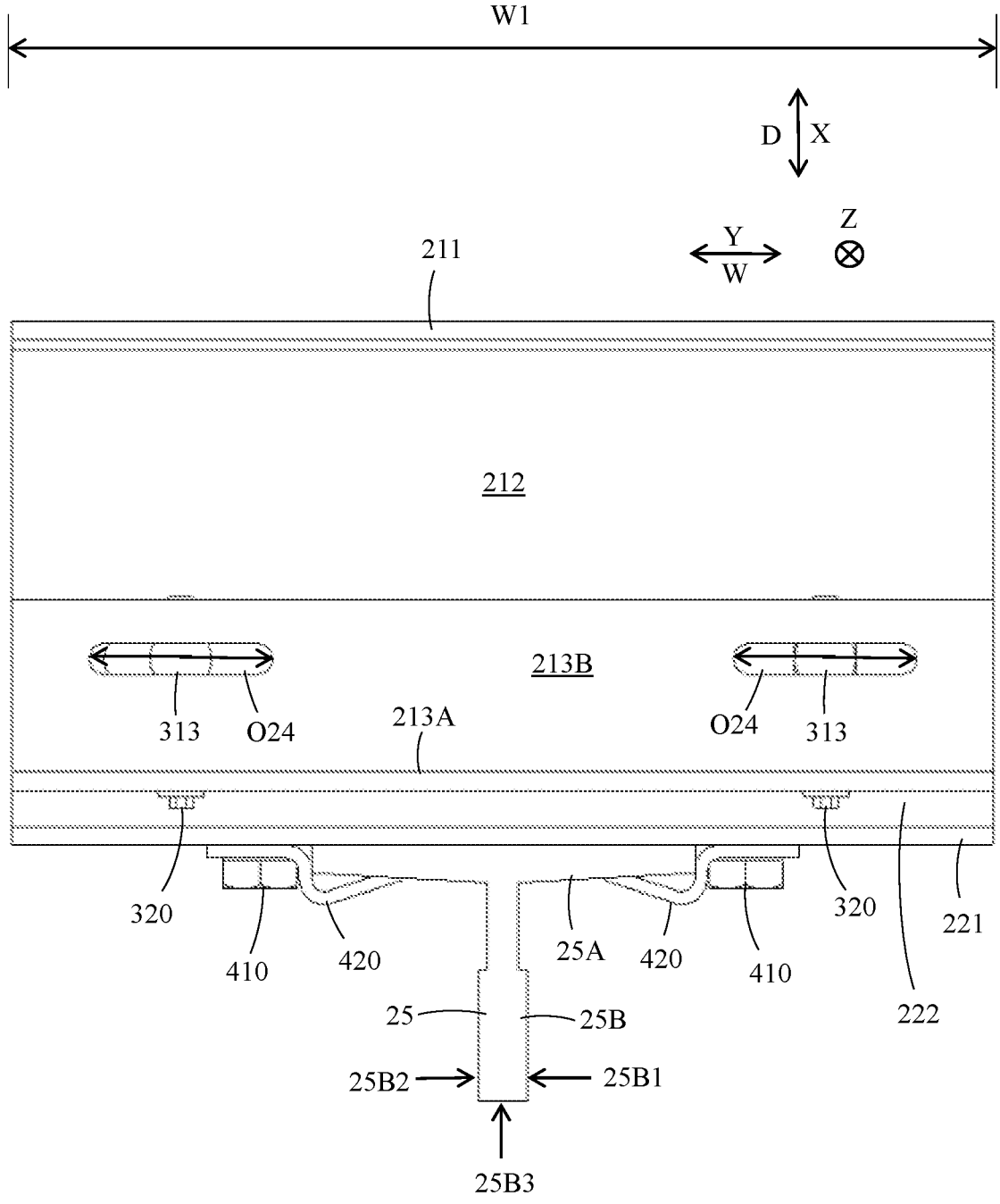
Figure 6:
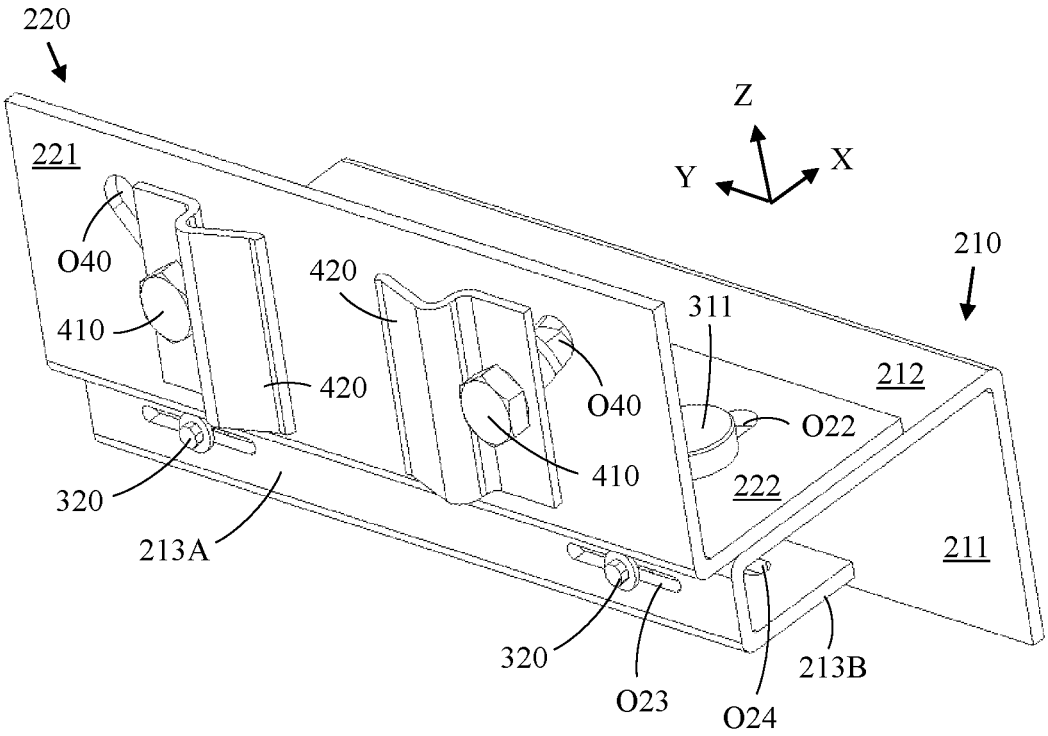
Figure 7:
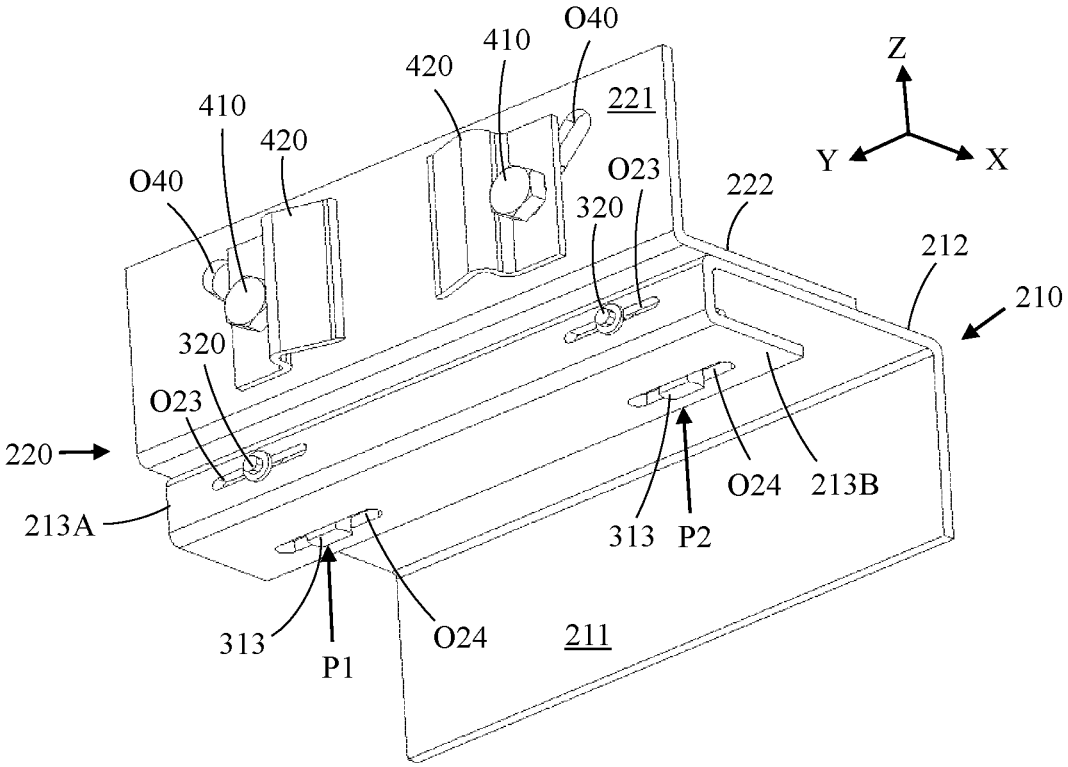

The invention will in the following be described in greater detail by means of preferred embodiments with reference to the attached drawings, in which FIG. 1 shows a side view of an elevator, FIG. 2 shows a horizontal cross section of the elevator, FIG. 3 shows a side view of a prior art fastening arrangement for elevator guide rails, FIGS. 4A and 4B show a side view of an inventive fastening arrangement for elevator guide rails, FIG. 5 shows a bottom view of the inventive fastening arrangement for elevator guide rails, FIG. 6 shows a first axonometric view of the inventive fastening arrangement for elevator guide rails, FIG. 7 shows a second axonometric view of the inventive fastening arrangement for elevator guide rails.

DETAILED DESCRIPTION

FIG. 1 shows a side view and FIG. 2 shows a horizontal cross section of the elevator.

The elevator may comprise a car 10, an elevator shaft 20, hoisting machinery 30, ropes 42, and a counterweight 41. A separate or an integrated car frame 11 may surround the car 10.

The hoisting machinery 30 may be positioned in the shaft 20. The hoisting machinery may comprise a drive 31, an electric motor 32, a traction sheave 33, and a machinery brake 34. The hoisting machinery 30 may move the car 10 in a vertical direction Z upwards and downwards in the vertically extending elevator shaft 20. The machinery brake 34 may stop the rotation of the traction sheave 33 and thereby the movement of the elevator car 10.

The car frame 11 may be connected by the ropes 42 via the traction sheave 33 to the counterweight 41. The car frame 11 may further be supported with guide means 27 at guide rails 25 extending in the vertical direction in the shaft 20. The guide means 27 may comprise rolls rolling on the guide rails 25 or gliding shoes gliding on the guide rails 25 when the car 10 is moving upwards and downwards in the elevator shaft 20. The guide rails 25 may be attached with fastening brackets 26 to the side wall structures 21 in the elevator shaft 20. The guide means 27 keep the car 10 in position in the horizontal plane when the car 10 moves upwards and downwards in the elevator shaft 20. The counterweight 41 may be supported in a corresponding way on guide rails that are attached to the wall structure 21 of the shaft 20.

The wall structure 21 of the shaft 20 may be formed of solid walls 21 or of open beam structure or of any combination of these. One or more of the walls may thus be solid and one or more of the walls may be formed of an open beam structure. The shaft 20 may be comprise a front wall 21A, a back wall 21B and two opposite side walls 21C, 21D. There may be two guide rails 25 for the car 10. The two car guide rails 25 may be positioned on opposite side walls 21C, 21D. There may further be two guide rails 25 for the counterweight 41. The two counterweight guide rails 25 may be positioned on the back wall 21B.

The guide rails 25 may extend vertically along the height of the elevator shaft 20. The guide rails 25 may thus be formed of guide rail elements of a certain length e.g. 5 m. The guide rail elements 25 may be installed end-on-end one after the other. Connection plates may be used to attach the ends of the guide rail elements 25. The guide rails 25 may be attached to the walls 21 of the elevator shaft 20 with fastening brackets.

The car 10 may transport people and/or goods between the landings in the building.

FIG. 2 shows plumb lines PL1, PL2 in the shaft 20, which may be produced by plumbing of the shaft 20 at the beginning of the installation of the elevator. The plumb lines PL1, PL2 may be formed with traditional vires or with light sources e.g. lasers having the beams directed upwards along the plumb lines PL1, PL2. One plumb line and a gyroscope or two plumb lines are normally needed for a global measurement reference in the shaft 20.

FIG. 1 shows the vertical direction Z i.e. the direction in which the car 10 moves in the elevator shaft 20. FIG. 2 shows a first horizontal direction X, which is the direction between the side walls in the shaft 20 and a second horizontal direction Y, which is the direction from the back wall to the front wall in the shaft 20. The first horizontal direction X is perpendicular to the second horizontal direction Y. The first horizontal direction X and the second horizontal direction Y are both perpendicular to the vertical direction Z.

FIG. 3 shows a side view of a prior art fastening arrangement for elevator guide rails.

The directions X, Y, Z are shown in the figure in a situation in which the fastening arrangement is used to support car guide rails positioned on opposite side walls of the shaft 20.

The fastening arrangement may comprise three bracket parts 110, 120, 130. Two of the bracket parts 110, 120 may have an L-shape with a vertical branch 111, 121 and a horizontal branch 112, 222. The vertical branch 111 of the first bracket part 110 may be attached to a wall 21 of the shaft 20 with a first fastening member 151 passing through a first hole O11 in the vertical branch 111 of the first bracket part 110. The horizontal branch 122 of the second bracket part 120 may be positioned on the horizontal branch 112 of the first bracket part 110.

The horizontal branch 112 of the first bracket part 110 and the horizontal branch 122 of the second bracket part 120 may be attached to each other in two first fastening points. Each of the first fastening points may comprise an opening O12, O13 in each of the horizontal branches 112, 122 and a third fastening member 153 passing through the openings O12, O13. The horizontal branch 112 of the first bracket part 110 may comprise a second longitudinal opening O12 extending in the first horizontal direction X. The horizontal branch 122 of the second bracket part 120 may comprise a third hole O13. The horizontal branch 122 of the second bracket part 120 may move in relation to the horizontal branch 112 of the first bracket part 110 in the first horizontal direction X when the third fastening member 153 is unlocked.

The third bracket part 130 and the vertical branch 121 of the second bracket part 120 may be attached to each other in two second fastening points. Each of the second fastening point may comprise an opening O14, O15 in the vertical branch 121 of the second bracket part 120 and in the third bracket part 130 and a second fastening member 152 passing through the openings O14, O15. The vertical branch 121 of the second bracket part 120 may comprise a fourth longitudinal opening O14 extending in the second horizontal direction Y. The third bracket part 130 may comprise a fifth hole O15. The third bracket part 130 may move in relation to the vertical branch 121 of the second bracket part 120 in the second horizontal direction Y when the second fastening member 152 is unlocked.

The guide rail 25 may be attached to the third bracket part 130 with a fourth fastening member 154 passing through a sixth hole O16 in the third bracket part 130. Clips 140 may be used to attach the guide rail 25 to the third bracket part 130. The guide rail 25 is thus movable in the second horizontal direction Y in relation to the second bracket part 120.

The first bracket part 110 and the second bracket part 120 may thus be adjusted in relation to each other in the first horizontal direction X i.e. in the direction between the guide rails DBG in the shaft 20 when the third fastening member 153 is unlocked. The guide rails 25 will thus be adjusted in the direction between the guide rails DBG. The guide rails 25 may further be adjusted in the second horizontal direction Y i.e. in the direction from the back to the front BTF in the shaft 20 when the second fastening member 152 is unlocked. The twist of the guide rail 25 may further be adjusted by rotating the horizontal branches 112, 122 in relation to each other.

The third fastening member 153 is operated in the vertical direction Z and positioned behind the vertical branch 121 of the second bracket part 120. This makes the adjustment of the bracket parts 110, 120 in relation to each other in the second direction Y difficult and time consuming. The position of the third fastening member 153 makes it also difficult if not almost impossible to automate the adjustment of the guide rails 25.

The first, second, third and fourth fastening member 151, 152, 153, 154 may be formed of bolts provided with nuts. A pressure joint is thus achieved between the head of the bolt and the nut when the nut is tightened against the bracket parts 110, 120, 130 positioned between the head and the nut.

FIGS. 4A and 4B show a side view of an inventive fastening arrangement for elevator guide rails.

The directions X, Y, Z are shown in the figure in a situation in which the fastening arrangement is used to support car guide rails positioned on opposite side walls of the shaft 20.

The fastening arrangement may comprise two bracket parts 210, 220. Each bracket part 210, 220 may comprise a vertical branch 211, 221 and a horizontal branch 212, 222. The vertical branch 211 of the first bracket part 210 may be attached to a wall 21 of the shaft 20. This can be done with a bolt which is not shown in the figure. The guide rail 25 may be attached to the vertical branch 221 of the second bracket part 220. The guide rail 25 may be attached with fastening members 410 and clips 420 to the vertical branch 221 of the second bracket part 220. The bracket parts 210, 220 may have a width direction W and a perpendicular depth direction D. The vertical branch 211 of the first bracket part 210 may face towards the wall in the shaft 20 to which the vertical branch 211 of the first bracket part 210 is attached to. The vertical branch 221 of the second bracket part 220 may face outwards from the wall in the shaft 20 to which the vertical branch 211 of the first bracket part 210 is attached to.

The horizontal branch 222 of the second bracket part 220 may be positioned on the horizontal branch 212 of the first bracket part 210.

The horizontal branch 212 of the first bracket part 210 and the horizontal branch 222 of the second bracket part 220 may be attached to each other through at least two fastening points P1, P2. Each fastening point P1, P2 may comprise a longitudinal opening O21, O22 in each horizontal branch 212, 222 of the two bracket parts 210, 220. The two longitudinal openings O21, O22 pass vertically through the respective horizontal branch 212, 222 of the two bracket parts 210, 220. A first longitudinal opening O21 may be provided in the horizontal branch 212 of the first bracket part 210 and a second longitudinal opening O22 may be provided in the horizontal branch 222 of the second bracket part 220. The first longitudinal opening O21 may extend in the width direction W within the horizontal branch 212 of the first bracket part 210. The second longitudinal opening O22 may extend in the depth direction D within the horizontal branch 222 of the second bracket part 220. The first longitudinal opening O21 and the second longitudinal opening O22 may extend in perpendicular directions.

A nest 213 may be arranged in connection with the horizontal branch 212 of the first bracket part 210. The nest 213 may be supported on the horizontal branch 212 of the first bracket part 210. The nest 213 may comprise a front wall 213A extending vertically outwards from the horizontal branch 212 of the first bracket part 210 and an outer wall 213B extending horizontally from the front wall 213A. A first end of the front wall 213A may be attached to the horizontal branch 212 of the first bracket part 210. A second opposite end of the front wall 213A may be attached to a first end of the outer wall 213B. The outer wall 213B may extend from the second end of the front wall 213A backwards towards the vertical branch 211 of the first bracket part 210. The front wall 213A and the outer wall 213B of the nest 213 may be made by bending the horizontal branch 212 of the first bracket part 210. The front wall 213A extends downwards from the outer end of the horizontal branch 212 of the first bracket part 210 and the outer wall 213B extends backwards from the outer end of the front wall 213A. The nest 213 has the shape of a lying letter U. The front wall 213A closes the front of the nest 213, but the sides and the back of the nest 213 may be open. The front wall 213A of the nest 213 may face outwards from the wall in the shaft 20 to which the vertical branch 211 of the first bracket part 210 is attached to.

A first fastening member 310 may extend vertically through the longitudinal openings O21, O22 in the horizontal branches 212, 222 of the bracket parts 210, 220 and further into the nest 213. The first fastening member 310 may have a bolt-shape. The first fastening member 310 may comprise a head 311 and a shank 312 with an outer end 313. The head 311 may seat on the upper surface of the horizontal branch 222 of the second bracket part 220. The shank 312 may extend from the head 311 to the outer wall 213B of the nest 213. The horizontal cross-section of the shank 312 may be circular. The outer end 313 of the shank 312 may extend into a fourth longitudinal slit O24 provided on the outer wall 213B of the nest 213. The horizontal cross-section of the outer end 313 of the shank 312 may be rectangular. The fourth longitudinal slit O24 may extend in the width direction W. The fourth longitudinal slit O24 may be formed of a fourth longitudinal opening O24 in the outer wall 213B of the nest 213. Another possibility would be to form the fourth longitudinal slit O24 with two upwards extending side walls on the horizontal bottom wall 213B. The two side walls would be parallel and extend in the width direction W. The fourth slit O24 would thus be formed between the two side walls. The outer wall 213B of the nest 213 could thus be solid.

The outer end 313 of the first fastening member 310 may be supported within the fourth longitudinal slit O24 in the outer wall 213B of the nest 213 so that the outer wall 213B of the nest 213 is movable along the fourth longitudinal slit O24 in relation to the outer end 313 of the first fastening member 310. The outer end 313 of the first fastening member 313 is on the other hand supported against movement in a direction perpendicular to the fourth longitudinal slit O24.

The shank 312 of the first fastening member 310 may comprise a wedge opening O30 passing horizontally through the shank 312 of the first fastening member 310. The wedge opening O30 may have a longitudinal shape with a first edge positioned near the outer wall 213B of the nest 213 and a second edge positioned within the longitudinal openings O21, O22 in the horizontal branches 212, 222 of the two bracket parts 210, 220. The wedge opening O30 may extend along a longitudinal centre axis of the first fastening member 310.

A second fastening member 320 may extend horizontally into the nest 213 through a third longitudinal opening O23 in the front wall 213A of the nest 213. The third longitudinal opening O23 may extend in the width direction W. The second fastening member 320 may be rotatably and movably to supported on the vertical front wall 213A of the nest 213. This may be done e.g. with washers positioned on both sides of the vertical front wall 213A of the nest 213. The washers may be fixed to the second fastening member 320. The second fastening member 320 may have a bolt-shape. The second fastening member 320 may comprise a head 321 and a shank 322. At least an outer end of the shank 322 may be provided with an outer threading. The second fastening member 320 may thus be rotated around a longitudinal centre axis of the second fastening member 320. The nest 213 may move laterally in the width direction W along the third longitudinal opening O23 in relation to the second fastening member 320.

A power transmission 330 may be operatively connected within the nest 213 to the second fastening member 320 and to the first fastening member 310. The power transmission 330 may transfer the rotational movement of the second fastening member 320 into a linear vertical movement of the first fastening member 310. The power transmission 330 may be formed of a tightening element 330. The tightening element 330 and the first fastening member 310 may generate a pressure joint between the horizontal branches 212, 222 of the two bracket parts 210, 220 in the fastening point P1, P2 when the second fastening member 320 is rotated around its longitudinal centre axis.

Rotation of the second fastening member 320 around the longitudinal centre axis of the second fastening member 320 in a first direction pulls the tightening element 330 towards the front wall 213A of the nest 213 and rotation of the second fastening member 320 around the longitudinal centre axis of the second fastening member 320 in a second opposite direction pushes the tightening element 330 away from the front wall 213A of the nest 213.

The tightening element 330, which is also shown separately in the figure, may be formed as a wedge comprising a first edge 331 and a second opposite edge 332. The first edge 331 may be horizontal and the second edge 332 may be inclined. The first edge 331 of the tightening member 330 seats against the lower surface of the horizontal branch 212 of the first bracket part 210. The second edge 332 of the tightening element 330 seats against the lower edge of the wedge opening O30 in the first fastening member 310. The second edge 332 of the wedge may have an angle $\alpha$1 of inclination in the range of 5 to 20 degrees, advantageously in the range of 5 to 10 degrees. An angle $\alpha$1 of inclination of 10 degrees means that a 10 mm horizontal movement of the wedge results in a 1.76 mm (10*tan(10°)=1.76 mm) vertical movement of the first fastening element 310. An angle $\alpha$1 of inclination of 5 degrees means that a 10 mm horizontal movement of the wedge results in a 0.87 mm (10*tan(5°)=0.87 mm) vertical movement of the first fastening element 310. The wedge functions as a power transmission, whereby the force applied by the second fastening member 320 on the wedge is fortified by the wedge acting on the first fastening member 310. The rotational movement of the second fastening member 320 is converted into a linear movement of the wedge.

The tightening element 330 may comprise a connection element 333 for connecting the tightening element 330 to the second fastening member 320. The connection element 333 may comprise a hole with an inner threading receiving the outer threading of the shank 322 of the second fastening member 320. Rotation of the second fastening member 320 around the longitudinal centre axis of the second fastening member 320 in a first direction moves the tightening element 330 in depth direction D towards the front wall 213A of the nest 213 and rotation of the second fastening member 320 around the longitudinal centre axis of the second fastening member 320 in a second opposite direction moves the tightening element 330 in the depth direction D away from the front wall 213A of the nest 213. The connection element 333 may form an integral part of the tightening element 330. Another possibility is that the connection element 333 is formed as a separate part and connected to the tightening element 330.

Movement of the tightening element 330 in the second direction Y to the left in the figure pulls the first fastening member 310 and thereby also the horizontal branch 222 of the second bracket part 220 downwards and pushes the upper edge 331 of the wedge 330 and thereby also the horizontal branch 212 of the first bracket part 210 upwards. The tightening element 330 works thus as a nut on the first fastening member 310. The horizontal branches 212, 222 of the bracket parts 210, 220 are pressed between the head 311 of the first fastening member 310 and the upper edge 331 of the tightening element 330 in the fastening point P1, P2.

The tightening element 330 may as an alternative be formed so that the first fastening element 310 passes through a longitudinal opening in the tightening element 330. The tightening element 330 could in such an embodiment be formed of two sheets, whereby the ends of the two sheets would be attached to each other and the longitudinal opening would be provided in the middle portion of the tightening element 330. The first fastening element 310 would then be provided with a flange near the outer end 313 of the first fastening element 310. The first upper edges of the tightening element 330 would seat against the lower surface of the first horizontal branch 211 and the second lower edges of the tightening element 330 would seat on the flange.

The bracket parts 210, 220 may be used to support car guide rails or counterweight guide rails. The first bracket part 210 and the second bracket part 220 may thus be adjusted in relation to each other in the first horizontal direction X i.e. in the direction between the guide rails DBG in the shaft 20 when the first fastening member 310 is unlocked. The guide rails 25 will thus be adjusted in the direction between the guide rails DBG. The guide rails 25 may further be adjusted in the second horizontal direction Y i.e. in the direction from the back to the front BTF in the shaft 20 when the first fastening member 310 is unlocked. The twist of the guide rail 25 may further be adjusted by rotating the horizontal branches 212, 222 in relation to each other.

FIG. 5 shows a bottom view of the inventive fastening arrangement for elevator guide rails.

The figure shows the width direction W and the depth direction D of the two bracket parts 210, 220. The width direction W extends in the second horizontal direction Y i.e. in a direction between the back wall and the front wall of the shaft 20 and the depth direction extends in the first horizontal direction X i.e. in a direction between the side walls in the shaft 20. This is the case when the bracket parts 210, 220 are used to support the car guide rails positioned on the opposite side walls of the shaft 20. The situation is different when the bracket parts 210, 220 are used e.g. to support the counterweight 41. The guide rails of the counterweight 41 could be positioned on the back wall of the shaft 20 or on either or on both side walls of the shaft 20.

The width direction W would extend in the first horizontal direction X i.e. in a direction between the side walls of the shaft 20 and the depth direction D would extend in the second horizontal direction Y i.e. in a direction between the back wall and the front wall of the shaft 20 when the bracket parts 210, 220 are used to support guide rails of a counterweight 41 positioned on the back wall of the shaft 20.

The figure shows also that the bracket parts 210, 220 have a width W1 in the width direction W. Both bracket parts 210, 220 may have the same width W1. The nest 213 may also have the same width W1 as the bracket parts 210, 220.

The guide rail 25 has the shape of a letter T with a bottom branch 25A and a support branch 25B. The support branch 25B comprises two opposite guide surfaces 2561, 2562 on opposite vertical side faces of the support branch 25B and one guide surface 2563 on the vertical front face of the support branch 25B. The guide rail 25 is attached from the bottom branch 25A with horizontal fastening members 410 and clips 420 to the vertical branch 221 of the second bracket part 220. The second fastening members 320 pass horizontally into the nest 213 through the front wall 213A of the nest 213. The outer wall 2136 of the nest 213 is provided with the fourth longitudinal slits O23 in the form of longitudinal openings. The fourth longitudinal openings O24 extend in the second horizontal direction Y. The outer end 313 of the first fastening members 310 are supported in the fourth longitudinal openings O24.

The horizontal branch 212 and the vertical branch 211 of the first bracket part 210 are also shown in the figure.

FIG. 6 shows a first and FIG. 7 a second axonometric view of the inventive fastening arrangement for elevator guide rails.

The fastening arrangement comprises two bracket parts 210, 220. Each bracket part 210, 220 comprises a vertical branch 211, 221 and a horizontal branch 212, 222. The vertical branch 211 of the first bracket part 210 may be attached to a wall of the shaft. This can be done with a bolt which is not shown in the figure. The guide rail may be attached to the vertical branch 221 of the second bracket part 220 with fastening members 410 and clips 420.

The first fastening member 310 passes vertically Z through the perpendicular longitudinal openings O21, O22 in the horizontal branches 212, 222 of the bracket parts 210, 220 and further into the fourth longitudinal slit O24 in the outer wall 213B of the nest 213.

The second fastening member 320 passes horizontally X into the nest 213 through the third longitudinal opening O23 in the front wall 213A of the nest 213.

The horizontal branches 212, 222 of the two bracket parts 210, 220 may be adjusted laterally in relation to each other in the first horizontal direction X and in the second horizontal direction Y due to the perpendicular longitudinal openings O21, O22 in the horizontal branches 212, 222 of the two bracket parts 210, 220. Longitudinal openings O23, O24 are further needed in the nest 213 in order to allow said lateral movement. The nest 213 is attached to the horizontal branch 212 of the first bracket part 210 and moves along with the first bracket part 210. The longitudinal openings O21, O23, O24 in the horizontal branch 212 of the first bracket part 210 and in the nest 213 are parallel and extend in the width direction W. The first bracket part 210 and the nest 213 may thus move in relation to the first fastening member 310 and the second fastening member 320 in the width direction W when the first fastening member 310 is unlocked.

The adjustment of the horizontal branches 212, 222 of the two bracket parts 210, 220 may thus be done from the front of the bracket parts 210, 220. The second fastening members 320 extend in the horizontal direction so that a direct horizontal access to the heads 321 of the second fastening members 320 is achieved from an installation platform moving upwards and downwards in the shaft 20. The first fastening member 310 may thus be opened and closed by only operating the second fastening member 320. No direct access to the first fastening member 310 is needed. The horizontal branches 212, 222 of the two brackets 210, 220 may be adjusted from the installation platform in order to achieve a correct position of the guide rail 25.

The guide rail is positioned on a middle portion in the width direction W of the vertical branch 221 of the second bracket part 220. The second fastening members 320 are positioned on both sides of the guide rail on outer portions of the front wall 213A of the nest 213. There is thus a free horizontal access to the second fastening members 320 from an installation platform moving in the shaft.

The inventive fastening arrangement of the guide rails 25 to the walls 21 in the shaft 20 may be used both in a manual and in an automated alignment of the guide rails 25 in a shaft 20. An automated alignment may be done partly manually and partly automatic or fully automatic. The invention will in a manual alignment of the guide rails speed up the alignment considerably. The invention will make it possible to automate the alignment process rather easily. A prior art automated alignment tool may be used in combination with a robot operating the second fastening member from an installation platform.

The embodiment shown in FIGS. 4-7 is an advantageous embodiment of the invention.

The construction shown in FIGS. 4-7 could as a first alternative be amended so that the horizontal branch 222 of the second bracket part 220 would be positioned below the horizontal branch 212 of the first bracket part 210. The horizontal branch 212 of the first bracket part 210 would then be straight. The nest 213 would be positioned below the horizontal branch 222 of the second bracket part 220. The nest 213 would be supported on the horizontal branch 222 of the second bracket 220. The vertical front wall 213A of the nest 213 would extend downwards from a point on the horizontal branch 222 of the second bracket part 220 near the vertical branch 221 of the second bracket part 220. The first longitudinal opening O21 in the horizontal branch 212 of the first bracket part 210 would extend in the depth direction D. The second longitudinal opening O22 in the horizontal branch 222 of the second bracket part 220 would extend in the width direction W.

The construction shown in FIGS. 4-7 could as a second alternative be amended so that the first bracket part 210 and the second bracket part 220 are turned around. The vertical branch 211 of the first bracket part 210 would be directed upwards and the vertical branch 222 of the second bracket part 220 would be directed downwards. The horizontal branch 212 of the first bracket part 210 would be positioned upon the vertical branch 222 of the second bracket part 220. The first fastening member 310 would extend vertically upwards through the longitudinal openings O21, O22 in the vertical branches 212, 222 to the nest 213 being positioned above the first branch 212 of the first bracket part 220.

The second alternative could further be amended so that the horizontal branch 212 of the first bracket part 210 would be positioned below the horizontal branch 222 of the second bracket part 220. The nest 213 would then be formed in connection with the horizontal branch 222 of the second bracket part 220. The nest 213 would then be supported on the horizontal branch 222 of the second bracket 220. The front wall 213A of the nest 213 would then extend upwards from a point on the horizontal branch 222 of the second bracket part 220 near the vertical branch 221 of the second bracket part 220.

The vertical branches 211, 221 of the two bracket parts 210, 220 extend in the FIGS. 4-7 in opposite directions. The vertical branch 211 of the first bracket part 210 extends downwards in the shaft 20 and the vertical branch 221 of the second bracket part 220 extends upwards in the shaft 20. This is an advantageous embodiment allowing easy access to the fastening means for fastening one vertical branch 211, 221 to the wall of the shaft 20 and for fastening the guide rail 25 to the opposite vertical branch 211, 221. The vertical branches 211, 221 of the two bracket parts 210, 220 could, however, also extend in the same direction i.e. either upwards or downwards in the shaft 20.

The bracket parts 210, 220 may be made of sheet material e.g. of a metal. The starting point may be a straight metal sheet having a suitable width and length. The metal sheet may then be bent into the desired form comprising the vertical branch 211 and the horizontal branch 221. Also the nest 213 may be made by bending from the same metal sheet in the embodiments in which the nest 213 is formed on the outer end of the horizontal branch 211, 221 of the bracket part 210, 220. The nest 213 may in other embodiments be formed as a separate part, whereby the vertical front wall 213A of the nest 213 may be attached to the horizontal branch 211, 221 of the bracket part 210, 220 e.g. by welding.

The tightening element 330 may be made from a sheet material e.g. of metal.

The invention may be used for fastening car guide rails and counterweight guide rails to the walls 21 in the shaft 20.

The use of the invention is not limited to the elevator disclosed in the figures. The invention can be used in any type of elevator e.g. an elevator comprising a machine room or lacking a machine room, an elevator comprising a counterweight or lacking a counterweight. The counterweight could be positioned on either side wall or on both side walls or on the back wall of the elevator shaft. The drive, the motor, the traction sheave, and the machine brake could be positioned in a machine room or somewhere in the elevator shaft. The car guide rails could be positioned on opposite side walls of the shaft or on a back wall of the shaft in a so called ruck-sack elevator.

It will be obvious to a person skilled in the art that, as the technology advances, the inventive concept can be implemented in various ways. The invention and its embodiments are not limited to the examples described above but may vary within the scope of the claims.

The invention claimed is:

1. A fastening arrangement for elevator guide rails, said fastening arrangement comprising:

two bracket parts with a width direction and a perpendicular depth direction, each bracket parts comprising a vertical branch and a horizontal branch; and two fastening points for mutual attachment of the horizontal branches of the two bracket parts, each fastening point comprising a first longitudinal opening extending in the width direction in a first horizontal branch, a second longitudinal opening extending in the depth direction in a second horizontal branch, and a first fastening member passing vertically through the two longitudinal openings, wherein a structure forming a nest is supported on the first horizontal branch so that the first fastening member extends vertically into the nest and a second fastening member extends horizontally into the nest, the first fastening member and the second fastening member being operatively connected to each other via a power transmission within the nest, whereby rotation of the second fastening member around a longitudinal centre axis of the second fastening member is transferred by the power transmission to a vertical linear movement of the first fastening element generating a pressure joint between the two horizontal branches of the two bracket parts in the fastening points.

2. The fastening arrangement as claimed in claim 1, wherein the structure forming the nest comprises a front wall extending vertically outwards from the first horizontal branch and an outer wall extending horizontally from the front wall, the second fastening member passing horizontally into the nest through a third longitudinal opening extending in the width direction in the front wall of the nest, the second fastening member being rotatably and movably supported in the front wall of the nest.

3. The fastening arrangement as claimed in claim 2, wherein an outer end of the first fastening member is movably supported on the outer wall of the nest.

4. The fastening arrangement as claimed in claim 3, wherein the power transmission is formed of a tightening element being operatively connected within the nest to the first fastening member and to the second fastening member.

5. The fastening arrangement as claimed in claim 3, wherein the outer wall in the nest comprises a fourth longitudinal slit extending in the width direction, the outer end of the first fastening member being supported in the fourth longitudinal slit.

6. The fastening arrangement as claimed in claim 2, wherein the outer wall in the nest comprises a fourth longitudinal slit extending in the width direction, an outer end of the first fastening member being supported in the fourth longitudinal slit.

7. The fastening arrangement as claimed in claim 6, wherein the fourth longitudinal slit in the outer wall of the nest is formed of a fourth longitudinal opening.

8. The fastening arrangement as claimed in claim 6, wherein a tightening element is formed of a wedge being arranged between the first horizontal branch and the outer end of the first fastening member, whereby movement of the wedge with the second fastening member in the depth direction causes the horizontal branches of the two bracket parts to be pressed together in the pressure joint between the first fastening member and the wedge.

9. The fastening arrangement as claimed in claim 2, wherein the power transmission is formed of a tightening element being operatively connected within the nest to the first fastening member and to the second fastening member.

10. The fastening arrangement as claimed in claim 1, wherein the power transmission is formed of a tightening element being operatively connected within the nest to the first fastening member and to the second fastening member.

11. The fastening arrangement as claimed in claim 10, wherein the tightening element is formed of a wedge being arranged between the first horizontal branch and an outer end of the first fastening member, whereby movement of the wedge with the second fastening member in the depth direction causes the horizontal branches of the two bracket parts to be pressed together in the pressure joint between the first fastening member and the wedge.

12. The fastening arrangement as claimed in claim 11, wherein the wedge comprises a first edge seating against the first horizontal branch and a second opposite inclined edge seating against the outer end of the first fastening member.

13. The fastening arrangement as claimed in claim 11, wherein the first fastening member comprises a head and a shank, the shank being provided with a longitudinal wedge opening for receiving the wedge, the longitudinal wedge opening having a first edge at a distance from an outer wall of the nest and a second opposite edge within the longitudinal openings in the horizontal branches of the two bracket parts, wherein a second edge of the wedge seats against the first edge of the wedge opening.

14. The fastening arrangement as claimed in claim 11, wherein the second fastening member is supported on a front wall of the nest with washers being fixedly attached to a shank of the second fastening member on opposite sides of the front wall of the nest, at least an outer end of the shank of the second fastening member being provided with an outer threading.

15. The fastening arrangement as claimed in claim 14, wherein the tightening element comprises a connection element for connecting the tightening element to the second fastening member, the connection element comprising a hole with an inner threading receiving the outer threading of the shank of the second fastening member, whereby rotation of the second fastening member moves the tightening element in the depth direction.

16. The fastening arrangement as claimed in claim 10, wherein the outer wall in the nest comprises a fourth longitudinal slit extending in the width direction, an outer end of the first fastening member being supported in the fourth longitudinal slit.

17. The fastening arrangement as claimed in claim 1, wherein each bracket part is made from a single blank of sheet material by bending.

18. The fastening arrangement as claimed in claim 1, wherein the vertical branches of the two bracket parts extend in opposite directions.

19. The fastening arrangement as claimed in claim 1, wherein the horizontal branch of the first bracket part is positioned below the horizontal branch of the second bracket part.

20. The fastening arrangement as claimed in claim 1, wherein the nest is formed as an integral part of one of the horizontal branches of the two bracket parts.

* * * * *